US011670158B2

(12) United States Patent
Koester et al.

(10) Patent No.: US 11,670,158 B2
(45) **Date of Patent: *Jun. 6, 2023**

(54) HYGIENE COMPLIANCE AND MONITORING SYSTEM

(71) Applicant: Tuway American Group, Inc., Troy, MI (US)

(72) Inventors: Douglas Koester, Troy, MI (US); Craig Muscott, Troy, MI (US)

(73) Assignee: Tuway American Group, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/079,751

(22) Filed: Oct. 26, 2020

(65) Prior Publication Data

US 2021/0043060 A1 Feb. 11, 2021

Related U.S. Application Data

(63) Continuation of application No. 15/830,647, filed on Dec. 4, 2017, now Pat. No. 10,818,157, which is a continuation-in-part of application No. 15/613,006, filed on Jun. 2, 2017, now Pat. No. 10,475,329.

(60) Provisional application No. 62/344,568, filed on Jun. 2, 2016.

(51) Int. Cl.

| | |
|---|---|
| ***G08B 21/24*** | (2006.01) |
| ***B05B 12/12*** | (2006.01) |
| ***B65D 83/08*** | (2006.01) |
| ***A47K 5/12*** | (2006.01) |
| ***B05B 12/00*** | (2018.01) |

(52) U.S. Cl.
CPC ..... *G08B 21/245* (2013.01); *A47K 5/1202* (2013.01); *A47K 5/1217* (2013.01); *B05B 12/004* (2013.01); *B05B 12/122* (2013.01); *B65D 83/0805* (2013.01)

(58) Field of Classification Search
CPC ... G08B 21/245; B05B 12/004; B05B 12/122; B05B 83/0805
See application file for complete search history.

(56) References Cited

U.S. PATENT DOCUMENTS

| | | | | |
|---|---|---|---|---|
| 5,202,666 A * | 4/1993 | Knippscheer | G08B 7/06 | 340/541 |
| 6,727,818 B1 * | 4/2004 | Wildman | G16H 50/80 | 340/573.1 |
| 7,375,640 B1 * | 5/2008 | Plost | A47K 5/1217 | 340/500 |

(Continued)

*Primary Examiner* — Hoi C Lau
(74) *Attorney, Agent, or Firm* — Young Basile Hanlon & MacFarlane, P.C.

(57) ABSTRACT

A method of hand hygiene compliance enforcement and hand hygiene system comprising at least one dispenser unit that has an interior chamber containing a volume of hand soap or sanitizer and a dispenser nozzle configured to dispense a measured volume of hand soap or sanitizing material upon a triggering event. The dispenser also has a control unit mounted therein, the control unit is in electronic communication with the dispenser nozzle and has at least one identity sensor, at least one alarm indicator and at least one transmitter. The hand hygiene system also has at least one proximity sensor in electronic communication with the control unit. The proximity sensor is located a spaced distance from the at least one dispenser.

17 Claims, 14 Drawing Sheets

(56) References Cited

U.S. PATENT DOCUMENTS 9,558,648 B2 1/2017 Douglas
9,668,601 B1 * 6/2017 Rogers ..... A61B 42/50
10,475,329 B1 * 11/2019 Koester ..... A47K 5/06
10,818,157 B1 * 10/2020 Koester ..... B05B 12/122
2004/0090333 A1 * 5/2004 Wildman ..... G16H 40/20 340/573.1
2007/0096930 A1 * 5/2007 Cardoso ..... G08B 21/245 340/573.4
2007/0213877 A1 * 9/2007 Hart ..... G07C 9/22 700/282
2007/0222554 A1 * 9/2007 Hart ..... G07C 9/25 340/5.6
2007/0289987 A1 * 12/2007 Tramontina ..... A47K 5/12 221/96
2008/0245812 A1 * 10/2008 Rogow ..... B65D 83/0829 221/155
2008/0246599 A1 * 10/2008 Hutton ..... G16H 40/20 340/529
2009/0051545 A1 * 2/2009 Koblasz ..... G08B 21/245 340/573.1
2009/0224907 A1 * 9/2009 Sinha ..... G08B 21/245 340/539.11
2010/0117836 A1 * 5/2010 Seyed Momen ..... G01S 1/7034 340/573.1
2010/0164728 A1 * 7/2010 Plost ..... G08B 21/245 340/573.1
2010/0315244 A1 * 12/2010 Tokhtuev ..... G06Q 10/00 340/603
2011/0227740 A1 * 9/2011 Wohltjen ..... G01S 11/16 340/573.1
2012/0194338 A1 * 8/2012 Snodgrass ..... G08B 21/245 340/539.12
2012/0256742 A1 * 10/2012 Snodgrass ..... G16H 40/20 340/539.12
2013/0113619 A1 * 5/2013 Snodgrass ..... G07C 11/00 340/539.11
2013/0127615 A1 * 5/2013 Snodgrass ..... G06F 21/35 340/539.13
2013/0342349 A1 * 12/2013 Cruz ..... G08B 21/245 340/573.1
2014/0092002 A1 * 4/2014 Manzari ..... G06F 3/04845 345/156
2015/0173546 A1 * 6/2015 Rogers ..... A61B 42/00 223/111
2015/0260543 A1 * 9/2015 Rantalankila ..... G01C 25/00 702/94
2016/0048161 A1 * 2/2016 Carceroni ..... G06F 1/163 361/679.03
2016/0054148 A1 * 2/2016 Misfatto ..... G01D 5/14 73/514.02
2016/0152430 A1 * 6/2016 Ray ..... A41D 19/015 242/563
2016/0275779 A1 * 9/2016 Hajdenberg ..... G08B 21/245
2016/0362242 A1 * 12/2016 Tao ..... B65D 83/0805
2017/0004287 A1 * 1/2017 O'Toole ..... G16H 20/30
2018/0122214 A1 * 5/2018 Freedman ..... G08B 7/06
2019/0391170 A1 * 12/2019 Kochar ..... G06Q 10/087
2021/0043060 A1 * 2/2021 Koester ..... B65D 83/0805

* cited by examiner

HYGIENE COMPLIANCE AND MONITORING SYSTEM

RELATED APPLICATIONS

This application is a continuation US Serial Number of Ser. No. 15/830,647 filed Dec. 4, 2017, which is a continuation-in-part of U.S. Ser. No. 15/613,006 filed Jun. 2, 2017, now issued as U.S. Pat. No. 10,475,329 on Nov. 12, 2019 which is a non-provisional utility application claiming priority to U.S. Provisional Application No. 62/344,568 filed Jun. 2, 2016, the specifications of which are all incorporated by reference herein.

TECHNICAL FIELD

This disclosure relates to monitoring, reporting and promoting the use of hand hygiene and glove products and processes. More particularly, the present disclosure pertains to perimeter-based systems that monitor and record handwashing and glove-use compliance within a defined area.

BACKGROUND

Hand care in the workplace affects both work-related activities and worker health. Hand hygiene is essential for certain activities and services including, but not limited to, healthcare, food preparation and food service. Hand hygiene is important for virtually all workplaces to maintain a healthy environment and to limit spread of bacteria, viruses and other disease-causing micro-organisms. Hand hygiene can be accomplished by washing with soap and water and/or by using liquids such as a waterless sanitizing product. Hygiene products that are used for hand hygiene are commonly dispensed by dispensers that are located where hand hygiene is desired. Hand skin care products can promote worker health in avoiding and treating hand skin conditions that can reduce worker performance and productivity. The invention concerns reporting use of hand care product dispensers for both hand hygiene and hand skin care.

In hospital settings, the spread of healthcare acquired infections known as HAI's is an increasing concern. HAIs can result from transmission of bacteria, viruses and other disease-causing micro-organisms from various sources such as a from a patient or from environmental surfaces to another patient or surface via the hands of healthcare workers. A consequence of such transmission can be infection of a patient who was previously not infected. Health care facilities have battled MRSA (methicillin-resistant *Staphylococcus aureus*) and VRSA (vancomycin-resistant *Staphylococcus aureus*) and other drug resistant micro-organisms for many years. These problems have been more apparent in recent years. It is estimated that approximately 2,000,000 such HAIs occur annually in the U.S. alone resulting in about 100,000 deaths. The extra costs associated with these infections are estimated in the billions of dollars.

In the food industry, the proper hand sanitization is necessary to prevent the spread of foodborne bacteria and/or viruses including Norovirus, the Hepatitis A virus, *Salmonella Typhi, Shigella* spp., and *Escherichia coli* (*E. coli*) O157:H7 or other Enterohemorrhagic or Shiga toxin-producing *E. coli, Staphylococcus aureus, Salmonella* spp. and *Streptococcus pyogenes*. Hand washing by food employees is essential after activities that contaminate hands and before activities during which pathogens may be spread to food. One of the activities in the food industry that can lead to food contamination and food borne illness is failure to exercise proper hand hygiene after using the toilet or entering the restroom area.

Food safety agencies, including the FDA have developed recommendations for managing facilities based on Hazard Analysis and Critical Control Point (HACCP) systems. Hand hygiene guidelines have been included in systems that are based on HACCP analysis. HACCP is based on seven principles, one of which is monitoring critical control points. Where hand hygiene is essential, HACCP principles call for monitoring of hand hygiene. As for healthcare hand hygiene guidelines, food related hand hygiene guidelines may be evaluated based on monitoring the number of hand hygiene events at a location within a food facility.

To further protect both workers and consumers from infection and disease, many procedures include protocols that require the worker to wear gloves in addition to performing hand hygiene procedures. Typically gloving will occur after hand hygiene and its necessity or requirement can vary from procedure to procedure. Thus, in certain settings, there may be situations or procedures that require hand hygiene and gloving, while others require or operation but not the other.

As with any mission-critical activity, it is desirable to be able to monitor compliance and to provide systems to encourage and remind workers about expected behaviors. While various systems have been proposed to remind workers about the necessity of hand washing and/or gloving at certain junctures in their work tasks, heretofore, none have been as successful as desired; particularly systems that monitor and prompt gloving alone or in combination with hand hygiene procedures.

Thus, it would be desirable to provide a system that would promote and remind workers of the necessity of hand hygiene and/or gloving at specific activity intervals during their workday. It would also be desirable to provide a system that would identify workers as they engage in the desired activity as well as those who are remiss so that good behavior can be rewarded and poorer performance can be corrected. Finally, it would be desirable to provide a system that could record compliance and non-compliance events both for certification and as a tool for continuing or ongoing worker training.

SUMMARY

Disclosed herein is a method of hand hygiene compliance enforcement and hand hygiene system comprising at least one dispenser unit that has an interior chamber containing a volume of hand soap or sanitizer and a dispenser nozzle configured to dispense a measured volume of hand soap or sanitizing material upon a triggering event. The dispenser also has a control unit mounted therein, the control unit is in electronic communication with the dispenser nozzle and has at least one identity sensor, at least one alarm indicator and at least one transmitter. The hand hygiene system also has at least one proximity sensor in electronic communication with the control unit. The proximity sensor is located a spaced distance from the at least one dispenser.

Also disclosed herein is a method of gloving enforcement compliance and a gloving compliance system that includes at least one glove dispenser unit that has an interior chamber containing a plurality individual gloves. The glove dispenser unit has a control unit mounted therein that is in electronic communication with at least one dispenser detector connected to the glove dispenser and with at least one alarm indicator and at least one transmitter. The glove dispenser unit also has at least one proximity sensor in electronic communication with the control unit.

Also disclosed herein is a method of hand hygiene and gloving compliance and a system that promotes and implements a protocol for hand hygiene and gloving that includes at least one hygiene dispenser unit containing a volume of hand soap or sanitizer and a dispenser nozzle configured to dispense a measured volume of hand soap or sanitizing material upon a triggering event. The system also includes at least one glove dispenser unit that has an interior chamber containing a plurality individual gloves. The at least one hand hygiene dispenser unit and the at least one glove dispenser unit communicate electronically with one another. The system also includes at least one control unit mounted to each of the hand hygiene dispenser and the glove dispenser with each control unit being in electronic communication with the respective dispenser regulator. The system has at least one identity sensor, at least one alarm indicator and at least and at least one transmitter. The system also has at least one proximity sensor in electronic communication with the control unit. The proximity sensor is located a spaced distance from the hygiene dispenser and the glove dispenser.

Also disclosed herein is a method of hand hygiene compliance and a system that promotes and implements a protocol for hand hygiene that includes at least one hygiene dispenser unit containing a volume of hand soap or sanitizer and a dispenser nozzle configured to dispense a measured volume of hand soap or sanitizing material upon the occurrence of a triggering event. The system also includes at least one control unit mounted to at least one of the hand hygiene dispensers with each control unit being in electronic communication with the respective dispenser regulator. The system has at least one identity sensor, at least one alarm indicator and at least and at least one transmitter. The system also has at least one proximity sensor in electronic communication with the control unit. The proximity sensor is located a spaced distance from the hygiene dispenser.

These and other aspects of the present disclosure are disclosed in the following detailed description of the embodiments, the appended claims and the accompanying figures.

BRIEF DESCRIPTION OF THE DRAWING

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity. Included in the drawings are the following figures.

DETAILED DESCRIPTION

Figure 1A:
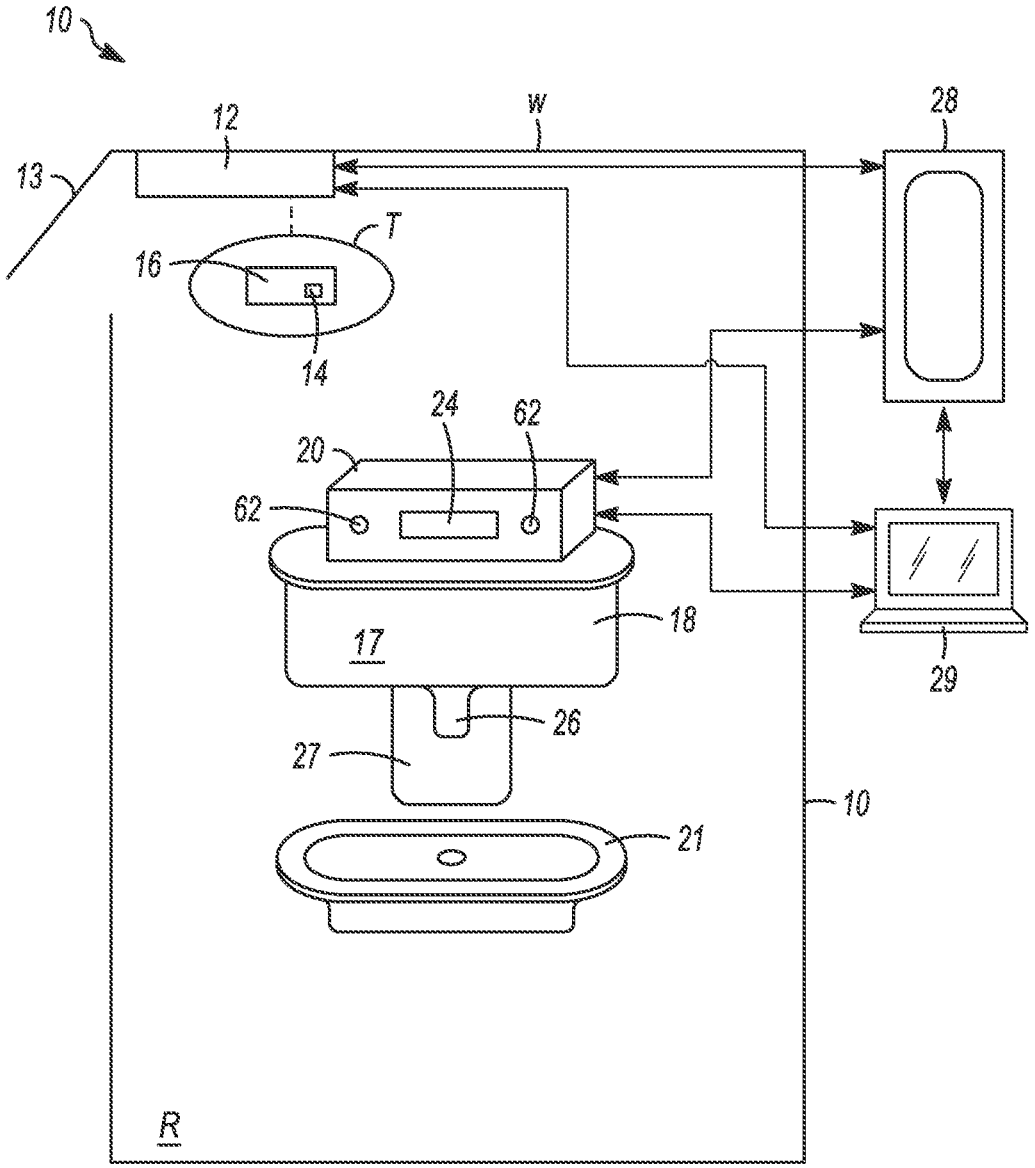
FIG. 1A is a schematic view of a hand sanitization and monitoring system according to a first embodiment as disclosed herein.

Disclosed herein is a method for monitoring and promoting hand hygiene and/or glove dispensing in a variety of employment settings. As broadly outlined, the method includes the steps of detecting a target individual such as a worker suitably equipped with a worker identification device as the target individual crosses a perimeter into a physical detection zone. The physical detection zone can be a room or other location equipped with at least one hand sanitation station that includes a sink, a hand sanitizer dispenser and a monitoring system and/or a glove dispenser. The method also includes the step of, determining that the hand sanitizer dispenser and/or the glove dispenser in the system has been activated while the target worker is proximate to the dispenser(s), the event within a predetermined detection interval after the target individual has crossed into the physical detection zone.

The hand sanitizer and/or glove dispensing device and monitoring system as disclosed herein includes at least one sensor array configured to define a detection zone perimeter and detect movement of at least one target individual into the detection zone. The hand sanitizer and/or glove dispensing device and monitoring system also includes at least one identity device associated with the target individual and at least one hand sanitation material dispenser and/or glove dispenser that is associated with a hand sanitizer station. In certain embodiments that includes a glove dispenser, it is contemplated that the hand sanitation station can be a sink or waterless sanitation dispenser. In embodiments where the hand sanitation station includes a sink, the system and optionally include at least one glove dispenser unit. The hand sanitation material dispenser and or glove dispenser has at least one monitoring array that is in communication with the at least one sensor array and in optional communication with at least one device external to the detection zone perimeter.

In one embodiment of the hand sanitation and monitoring system as disclosed and depicted in FIGS. 1A-C, 2 and 3, at least one sensor array 12 is configured to be mounted to a suitable structural member in order to define a detection zone and to identify and detect movement of at least one target individual proceeding into or leaving the defined detection zone. In certain embodiments, the detection zone will be a room R or other architectural space having one or more temporary or permanent wall structures W or boundary demarcations. In such situations, the sensor array 12 can be operatively positioned to detect movement of the target individual T into or out of the room R. Where the room R has a defined entryway such as entryway 13, the sensor array 12 can be mounted adjacent to the entryway 13 in order to monitor ingress and egress pertaining to the room R. Where desired or required, one or more sensor arrays can be employed.

It is contemplated that the sensor array and or associated system can be configured to detect movement in an x-axis transiting the entryway 13 while disregarding movement of one or more target individuals that do not transit the entryway such as those that move parallel to the doorway as in the Y-axis.

The at least one sensor array 12 is configured to detect the presence of a compatibly configured identity device 14 that located in an employer-issued identity card 16 and carried by the target individual T. The identity card 16 can be configured with any suitable identity device 14, for example a suitable RFID readable chip or the like. The identity card 16 can be configured to be worn in a visible manner as on a lanyard or the like and can include other features and functionalities as desired or required. Non-limiting examples of other functionalities can swipe card entry and the like. The at least one sensor array 12 can be equipped with detection mechanism(s) such as suitably configured RFID readers. Where desired or required, the at least one sensor array can be configured with direction sensing devices configured to ascertain whether the target individual T is entering into the defined perimeter or exiting from the space. However, the method and device disclosed herein are not necessarily limited to such configurations detecting ingress and egress.

The hand sanitation/glove dispensing monitoring system 10 also includes a suitably configured hand hygiene material dispenser 18 that is located within the perimeter monitored by the sensor array 12. The hand hygiene material dispenser 18 is composed of a chamber 17 that is configured to contain a volume of a suitable cleaning material that can be dispensed in measured dose volumes. It is contemplated that the cleaning material will be a suitable soap or detergent that can be used with water to effect suitable hand cleanliness. The chamber 17 can be refillable and can be configured with a suitable refilling aperture (not shown).

The hand sanitation/glove dispensing and monitoring system 10 is associated with and is in electronic communication with a dispenser controller 20. In the embodiment depicted in FIG. 1A, the hand hygiene controller 20 is mounted on the dispenser chamber 17. In some embodiments, the hand hygiene dispenser controller 20 can be in electronic communication with two or more hand hygiene dispensers 18. In such applications, it is contemplated that the controller 20 can be mounted separately or can be located on one dispenser 18 which serves as the master controller.

Figure 1B:
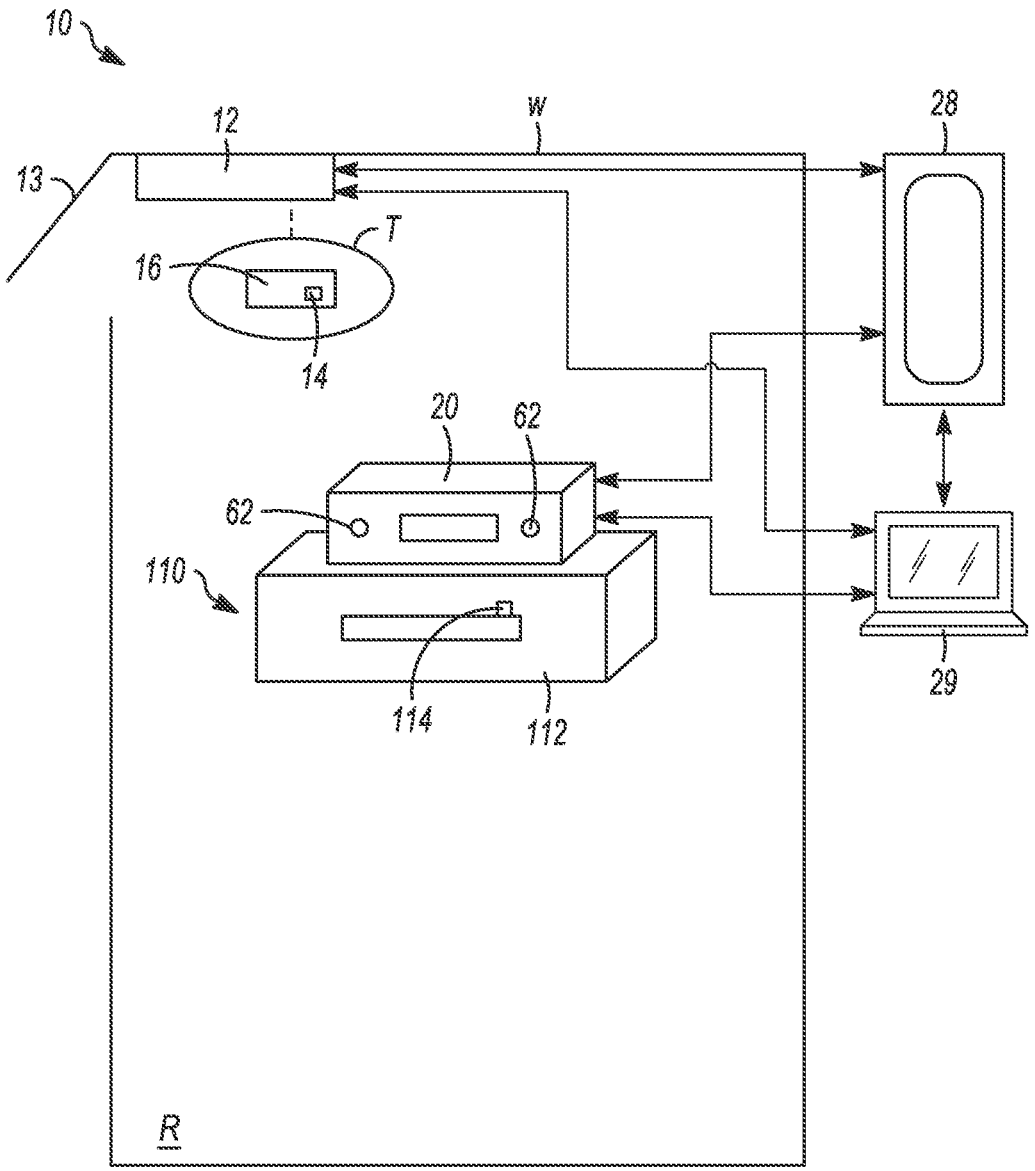
FIG. 1B is a schematic view of a glove dispensing and monitoring system according to a second embodiment as disclosed herein.

In the embodiment depicted in FIG. 1B, the hand sanitation/glove dispensing and monitoring system 10 can include a glove dispenser 110 having a dispensing chamber 112 that can house a plurality of disposable gloves (not shown). The dispensing chamber 112 can include suitable sensor such as sensor 114. The sensor 114 can be configured to index or sense individual gloves as they are dispensed. The dispensing chamber 112 can be associated with dispenser controller 20 in electronic communication that can be associated with one or more glove dispensers. As with the embodiment depicted in FIG. 1B, the controller 20 can be mounted separately or can be located on one or dispenser that serves as the master controller.

Figure 1C:
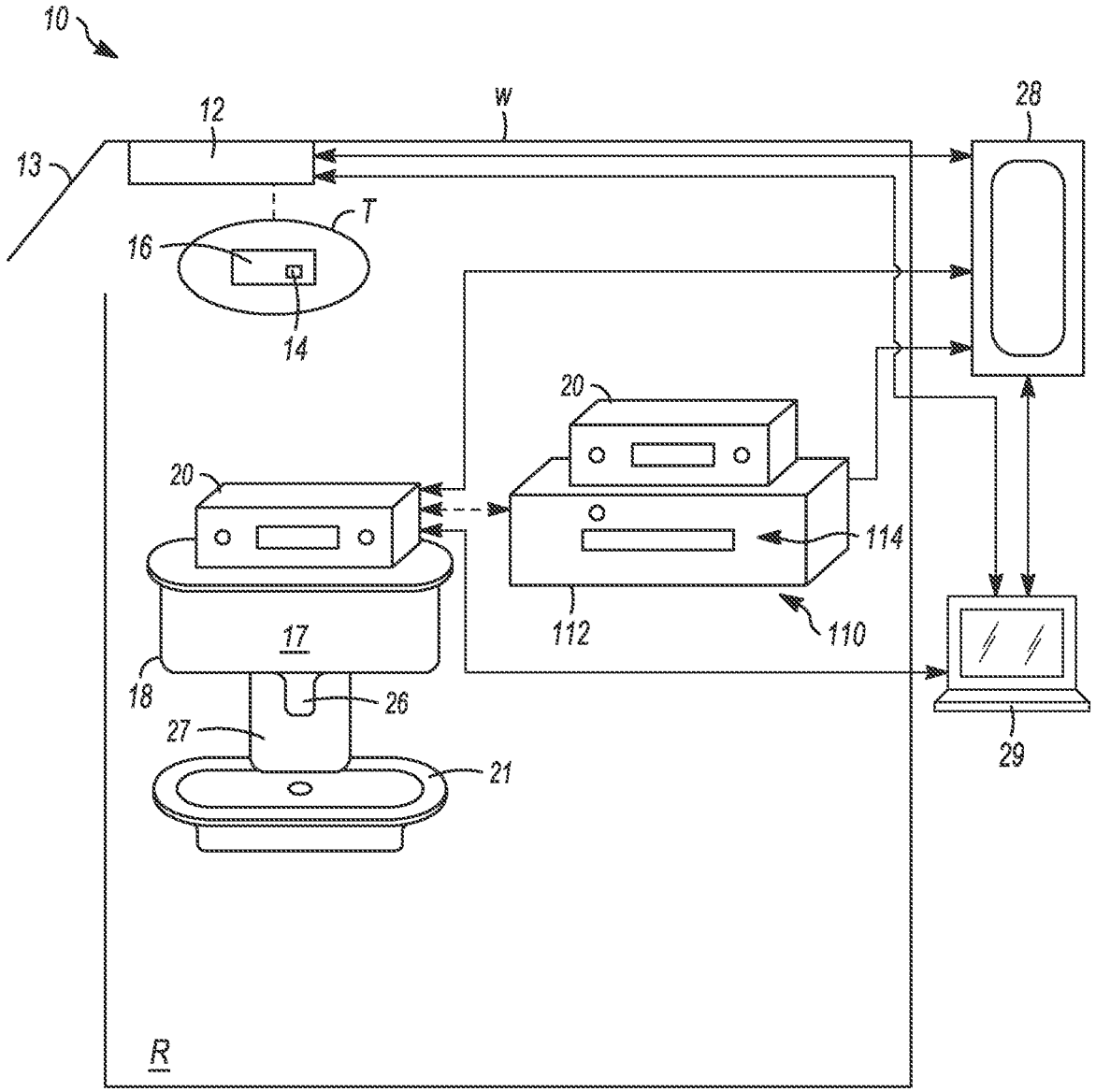
FIG. 1C is a schematic view of a hand sanitizer, glove dispensing and monitoring system as disclosed herein.

In the embodiment depicted in FIG. 1C, the monitoring system includes at least one hand hygiene material dispenser 17 and at least one glove dispenser 110 that can be connected electronically with at least one controller 20. In certain embodiments, the hand hygiene dispenser 17 and the glove dispenser 110 can each be directly connected to the controller. Alternately, it is contemplated that the hand hygiene dispenser 17 and the glove dispenser 110 can be serially connected as desired or required.

In various embodiments of the system such as the embodiment as depicted in FIG. 1B as disclosed herein, the hand hygiene dispenser 18 can be placed proximate to a source of running water such as a sink 21 that is located within the associated room R. It is contemplated that the hand hygiene dispenser controller 20 can be incorporated in the individual hand hygiene dispenser 18 as depicted the non-limiting embodiment in FIG. 1A. It is also considered with in the purview of this disclosure that the dispenser controller 20 can be located a position remote to the hand hygiene material dispenser 18. In certain embodiments of the system as disclosed herein, the system can be configured with at least one glove dispenser—either alone or in combination with one or more glove dispensers.

The dispenser controller 20 can include a central processing unit and a timing unit as well suitable data storage and transmission mechanisms. In embodiments where at least one dispenser 18, 110 is employed, the controller 20 can be integrated into one or more dispensers 18, 110. In embodiments where more than one hand hygiene dispenser 18 is present in room R, the hand hygiene dispenser controller 20 can be incorporated into one of the units or can be present as a stand-alone unit in electronic communication with the various individual hand hygiene dispensers. Similarly, where one or more glove dispensers are present in a room R, the controller 20 can be incorporated into one or more of the units or can be present as a stand-alone unit. In embodiments where the system is configured with one or more hand hygiene material dispensers 17 in combination with one or glove dispensers 110 at suitable locations around the room R.

Figure 2:
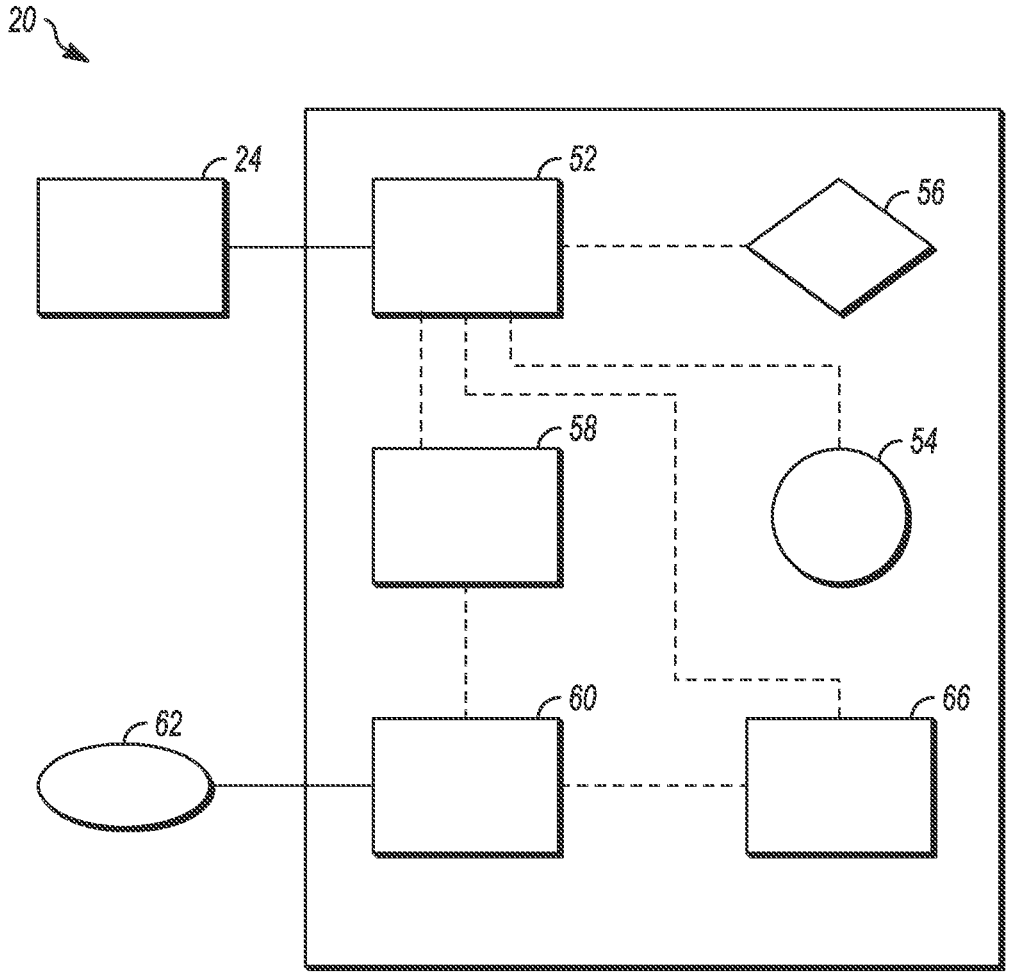
FIG. 2 is a schematic diagram of a controller unit according to an embodiment as disclosed herein.

A non-limiting embodiment of the hand hygiene/glove dispenser controller 20 is schematically depicted in FIG. 2. The hand hygiene/glove dispenser controller 20, can include a suitable central processing unit (CPU) 52 that is operatively connected to a suitable receiver 54 and transmitter 56. The receiver 54 and transmitter 56 can be configured to facilitate wireless transmission and reception. The central processing unit 52 can include or be operatively connected to a timer 58 that can be linked to the control of an alarm 60 as well other devices and functionalities (not shown). The alarm 60 can be operatively linked to one or more audible and/or visible devices 62 such as LED lights, speakers, and the like.

In certain embodiments, such as the embodiment depicted in FIG. 1A, the audible and/or visible device(s) 62 can be located on or proximate to the hand hygiene dispenser 18. The audible and/or visible device(s) 62 can emit as series of chirps, light flashes or the like in order to direct the attention of target worker T to the one or more hand hygiene dispenser(s) 18 present in the room R and remind the target worker T of the need to engage in hand hygiene activities to be completed either upon room entry and/or prior to room exit depending on the nature of the occupation of the target worker T.

The hand hygiene dispenser controller 20 can also include or be linked to at least one suitable hand hygiene dispenser sensor 24. In certain embodiments, the hand hygiene dispenser sensor 24 is configured as a proximity sensor and identity reader. The hand hygiene dispenser sensor 24 is configured to determine the presence of a previously identified target worker T. In the system, as disclosed herein, the dispenser sensor 24 determines the proximity of the identity card 16 of the target worker T by located and interrogating the data associated with identity device 14. Information previously detected by sensor array 12 can by conveyed to hand hygiene dispenser controller 20 where it can be stored and compared to information received from sensor 24 to determine correspondence. It is contemplated that the information collected from the sensor array 12 can be conveyed by any suitable means, for example via wired or wireless transmission. The various elements can be operatively linked to a suitable processing unit such as CPU 52 that is associated with a suitable digital receiver such as receiver 54

In certain embodiments, the warning alarm can be positioned in the hand hygiene dispenser 18 in the hand sanitation and monitoring system 10 hand hygiene dispenser in a manner that will catch the attention of the target worker T and alert him or her to the need to engage in the appropriate hand hygiene protocol. The warning alarm can be a visible signal, an audible signal, or a combination of the two emanating from the hand hygiene unit 18 in order to draw attention of the target worker T to the hand hygiene dispenser unit 18.

The hand hygiene unit 18 can have a suitable proximity sensor 24 that is integrated in the hand hygiene dispenser unit 18. The proximity sensor 24 in electronic communication with the controller 20, 120. The proximity sensor 24 can be configured to identify the ID device 16 associated with the target worker T and convey data to the associated CPU 52 where the CPU 52 can query the collected data to determine whether the perceived ID device 16 has been recently identified by the perimeter sensor array 12.

The CPU 52 contains suitable program logic to compare correspondence between ID devices 16 read that are proximate to proximity sensor 24 with those detected by sensor array 12. If the ID device 16 detected by the proximity sensor 24 associated with the hand hygiene device 18 corresponds to the ID device 16 detected by the sensor array 12 any activation of the warning alarm 62 can be cancelled. The suitable timer 58 is configured to measure and record actual time and/or elapsed time between detection of the target worker T by sensor array 12 and detection of target worker T by sensor 24 and/or actuation of the trigger 27 and/or nozzle 26.

In order to assure that the ID device 16 detected by proximity sensor 24 actually uses the dispenser 18, the dispenser 18 can be configured such that dispenser nozzle 26 and/or trigger mechanism 27 is connected to a detector or sensor (not shown) that is configured to generate at least one command signal that can act on the controller 20 and alarm 62 to discontinue alarm operation. The sensor associated with the trigger 27 and/or nozzle 26 produces a signal that is conveyed to the controller 20 indicting that a measure volume of soap material has been dispensed from the dispenser 18. This operates to discontinue alarm operation. It can also trigger a transmission of a compliance message to at least one externally located device such as device 28. The externally located device 28 can be any suitable device such as a data recorder (not shown), cell phone 28 or computer device 29 for further processing and the like.

Triggering of dispenser nozzle 26 is taken to mean that a portion of the hand soap or cleaning agent present in the dispenser 18 has been dispensed and the worker has engaged in the employer-mandated hand washing protocol. Thus, receipt of affirmative messages by CPU 52 is construed as compliance. Transmission data can include components that include, but are not limited to, one or more of the following: completion of the affirmative action, identification of the associated target worker T, location of the specific system 10, date and time of the recorded specific compliance event.

Failure to observe and execute the employer-mandated handwashing protocol can also be addressed by the handwashing compliance system 10 as disclosed herein. In operation, the detection of entry of the target worker T into the room R as detected by sensor array 12 can initiate or trigger the internal timer device present in the controller 20 to measure a predetermined time interval. At the expiration of this time interval, the controller and associated CPU produces a signal that triggers operation of the alarm 62. If the target worker T, approaches the dispenser 18 and actuates the trigger 27 and nozzle 26, the operation of the timer is discontinued upon receipt of appropriate compliance messages, namely the detection of the ID chip 16 of the target worker T and triggering of the dispenser by actuation of the trigger mechanism 27 and/or nozzle 26. Delay in detection by the proximity sensor 24 and triggering the trigger 27 and/or nozzle 26 past the pre-programmed timer interval results in actuation of the alarm 62 to remind the target worker T of the desired action.

Disregard of the alarm 62 by the target worker T is considered indicative of non-compliance with the desired employer-mandated handwashing protocol. In the event that the target worker T does not approach the hand hygiene dispensing unit 18 and his ID 16 is not detected by the dispenser mounted proximity sensor 24, the controller 20, transmits a non-compliance message signal to at least one externally located receiver 28, 29. Alternately, or in addition to this non-compliance event message, if the target worker T passes through the sensor array 12 located at the perimeter of the room R without first being detected by the dispenser mounted proximity sensor 24 present on the dispenser unit 18 together with triggering the dispenser nozzle 20, a non-compliance message can be generated as at reference for transmission to the external device 28, 29.

The non-compliance message can be transmitted in any suitable manner as by wireless communication networks to an externally located receiver 28 for further processing, analysis. Non-limiting examples of externally located receivers include one or more suitably configured cell phones 28, computers 29, externally located processing units, etc.

Transmission can be in real time or can be batched depending on the requirements of the given installation. Where real time transmission is employed, it is envisioned that the transmission can be in the form of non-compliance alerts. Where batched transmission is employed, it is envisioned that the transmission can be in the form of compliance reports. Non-limiting examples of such reports will be discussed subsequently. It is also contemplated that transmission can be a combination of real-time and batched reports. It is also considered to be within the purview of this disclosure that transmission of a given message can include one or more commands actionable on one or more devices remote to the room being monitored.

In certain embodiments such as the embodiment depicted in FIG. 1B, the audible and/or visible devices(s) 62 can be positioned on a suitable face of the glove dispenser 110. The audible and/or visible device(s) 62 can emit as series of chirps, light flashes or the like in order to direct the attention of target worker T to the one or more glove dispenser(s) 110 and remind the target worker T of the need to don gloves as in the manner described previously in conjunction with the hand hygiene dispenser.

It is also contemplated that, in certain embodiments, the system will include a device that includes a combination of at least one hand hygiene dispenser 17 and at least one glove dispenser 110, with the at least one hand hygiene material dispenser 17 electronically connected to the perimeter sensor 12 and triggering the warning sequence with a triggering event as outlined previously. It is contemplated that the triggering event can result in commands being transmitted to the hand hygiene material dispenser unit and to the and the glove dispenser to activate audible and/or visible device(s) 62 that are associated with the respective dispenser. It is contemplated that respective audible and/or visible device(s) 62 can be activated by a single triggering event and can activate simultaneously in certain embodiments. If the activations of the respective audible and/or visible device(s) are simultaneously triggered, it is contemplated that the proximity to the respective sensors 24 can produce a command to deactivate the associated respective audible and/or visible device 62. It is also considered within the purview of this disclosure that activation of the of the respective audible and/or visible device(s) 62 can be sequential or time lagged such that the glove dispenser alarms are triggered subsequent to the triggering of the hand hygiene dispenser alarms in order to remind the target worker T of the appropriate activity sequence when entering the room R.

Figure 3A:
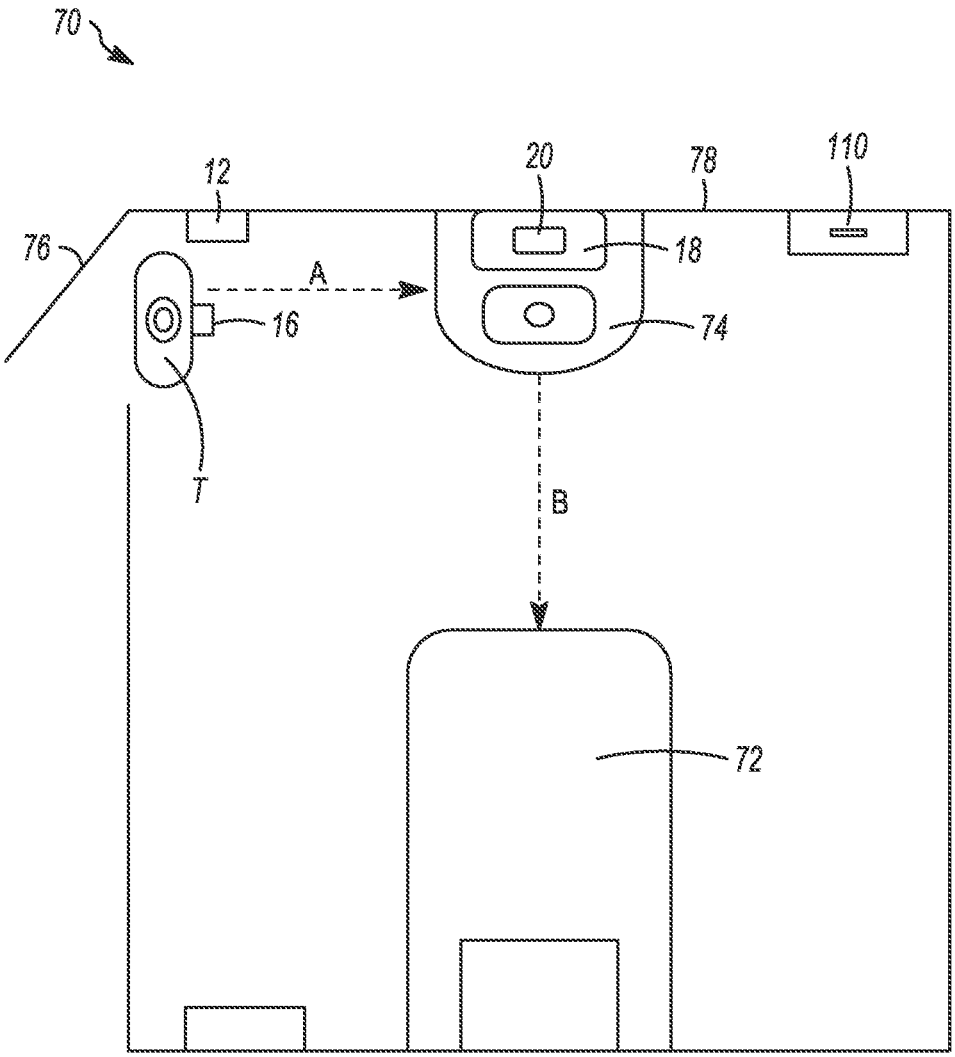
FIG. 3A is a schematic room diagram including the embodiment of FIG. 1A.
Figure 3B:
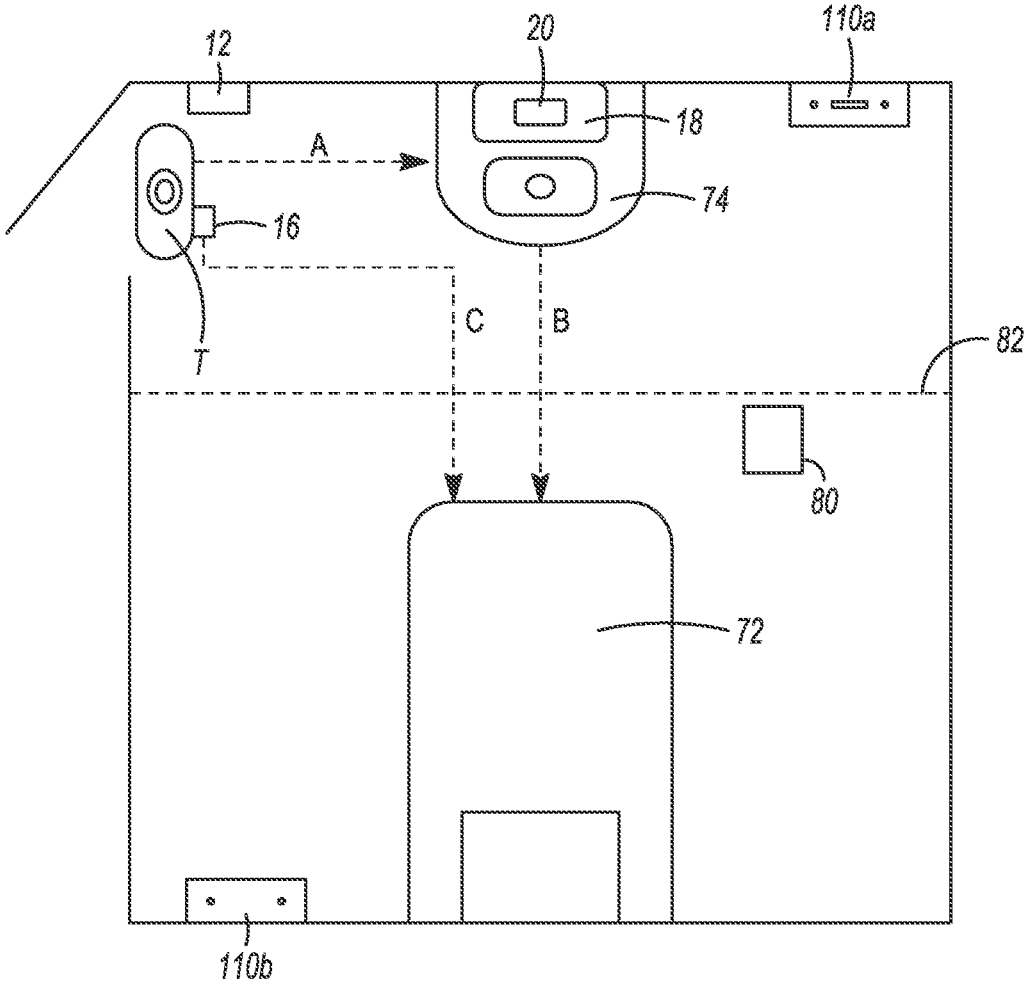
FIG. 3B is a schematic room diagram of FIG. 3A including interior boundary sensor device.
Figure 4:
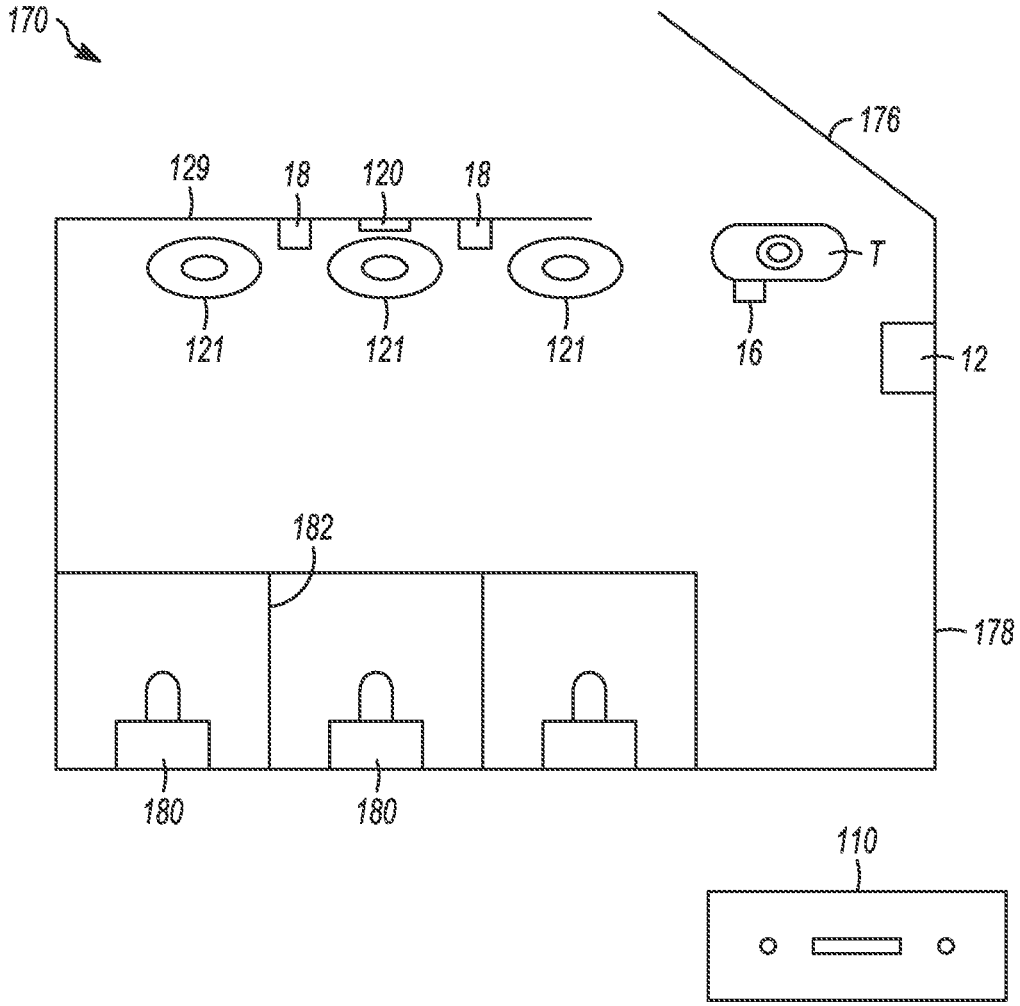
FIG. 4 is a schematic room diagram including a second embodiment of the system as described herein.

To better understand the method and device disclosed herein attention is directed to schematic diagrams depicted in FIGS. 3A and 3B and 4. FIG. 3A depicts a medical examination room or hospital room 70 configured with an embodiment of the hand sanitation and monitoring system 10 as disclosed herein. The examination room or hospital room 70 includes at least one patient treatment table or bed 72 and a handwashing sink or station 74. The entryway sensor array 12 is mounted proximate to the doorway 76 of treatment or patient room 70. The entryway sensor array 12 may include a suitable on-board power source such as a battery solar cell or the like. It is also contemplated that the entryway sensor array 12 can be connected to an external source of power as required (not shown). Entryway sensor array 12 is be positioned such that the presence, movement and identity of a target worker T entering the room 70 can be ascertained. In the embodiment depicted, the entryway sensor array 12 is located on a wall 78 proximate to the doorway 76. It is also contemplated that the entry way sensor array 12 may be positioned on the associated door 76, on the lintel, or other suitable location. The entryway sensor array 12 can be configured to emit a suitable RFID signal or read one emitted by an RFID device 16 or other suitable identifying device integrated into the worker identity tag worn by the targeted worker T depicted as entering the room. The entryway senor array can include a suitable transmission device (not shown) that is configured to transmit pertinent data to the controller 20.

A signal indicting detection of a target worker T as derived from detection of the ID tag 14 of the target worker T as well as any associated worker identity information can be transmitted by the entryway sensor 12 to a hand hygiene material dispenser 18 that is located proximate to the handwashing station or sink 74. The signal, along with any associated ID information, can be received by receiver 54 located in the controller unit 20 connected to on the hand hygiene material dispenser 18. If gloving is also required, the appropriate activation signals can be conveyed to the glove dispenser 110.

In various heath care settings standard protocol requires the worker to wash his or her hands prior to making contact with the patient located in bed 72. Thus, the target worker T would initially approach the sink 74 and associated dispenser 18 generally along path A. After the hand hygiene regimen has been followed (together with any gloving as required), the target worker T would approach the patient in bed 72 as along pathway B.

The signal emanating from entryway sensor array 12 can trigger a timer mechanism that is contained in the controller unit 20 of hand hygiene dispenser 18. Once a predetermined time has elapsed, the controller 20 can actuate an audible and/or visible warning alarm 62 designed to remind the target worker T that hand hygiene operations must be promptly attended to. The warning alarm 62 can be a type that directs the attention of the target worker T attention to the hand hygiene dispenser unit 18 (and/or the glove dispenser 110). This can be a light, a flashing light, an audible alarm or a combination of the same. It is within the purview of this disclosure that the intensity of the alarm can vary with elapsed time to increase in intensity as time continues. In certain embodiments, activation of the alarm 62 can commence after a predetermined interval; typically, an interval sufficient to permit the average target worker T to reach the dispenser unit 18. The alarm 62 can commence at the expiration of the predetermined interval and can increase in intensity as time elapses, if desired or required.

Once the target worker T reaches the hand hygiene dispenser 18, the worker ID badge 16 can be detected when the target worker T is proximate to the hand hygiene dispenser 18. Activation of the dispenser nozzle 26 or trigger 27 together with detection of the worker ID badge 16 can produce a command signal to discontinue alarm activation and to record a compliance with hand washing protocol.

If the target worker T ignores the alarm 62 and fails to activate the nozzle 26 and trigger 27 of hand hygiene dispenser 18 and/or a suitable dispatch sensor such as sensor 114 associated with the glove dispenser 110, the hand sanitation and monitoring system 10 records the event as non-compliance and transmits the information to the remote detection device 28, 29. In certain embodiments, the non-compliance signal will be delayed until the exit target worker T from the monitored room 70 is detected by the sensor array 12.

It is also considered within the purview of the present disclosure that the hand sanitation and monitoring system 10 can be configured to include protocols that distinguish between classes of target workers T. This distinction can be derived from the identity of the given worker and can include readable data resident on the worker ID badge 14 regarding the classification of the specific target worker T. By way of example, in a health care setting, target workers such as nurses, aides, orderlies and the like whose job description required direct patient contact would be expected to engage in defined hand hygiene activities and/or gloving as required. Entry of a member of this class of workers would trigger the hand hygiene and/or gloving protocol previously discussed. Certain workers such as dietary aides, social worker and the like may be required to enter the room 70 briefly and without direct patient contact. These workers can be classified differently such that detection by the sensor array 12 and identification by controller 20 does not trigger the monitoring protocol.

An alternate embodiment of the system is depicted in FIG. 3B that includes an inner boundary sensor 80. Inner boundary sensor 80 can be positioned at a suitable location in the interior of a patient room and can be configured to detect transit toward the sensor 80 and past a boundary 82 defined thereby. The system can be configured to ascertain that a target individual who is otherwise exempted from the hand washing requirement has approached or passed through a defined inner boundary proximate to bed 72 and, in so doing, is now required to conduct handwashing operations which if not registered will trigger the alarm protocol as defined previously. As depicted in FIG. 3B, the system includes a glove dispenser 110*a* located proximate to the hand hygiene station 18 and a glove dispenser 110*b* located at a position distal to the hand hygiene station. In such situations, triggering of the inner boundary sensor can also be programmed to trigger activation of the auxiliary glove dispenser 110*b*.

An alternate embodiment and application is depicted in FIG. 4. FIG. 4 depicts a restroom 170 typically found in a food service establishment such as a restaurant for food processing plant. Food service installations typically require that all workers wash their hands after being in the rest room. Smaller establishments may require that workers and patrons use the same facilities.

The rest room 170 is configured with an embodiment of the hand sanitation and monitoring system 10 as disclosed herein. The rest room 170 as depicted in FIG. 4 includes at least one toilet 180 present in stall 182 as well as a plurality of sinks 121. The entryway sensor array 12 is mounted proximate to the doorway 176 of rest room 170. The entryway sensor array 12 may include a suitable on-board power source such as a battery solar cell or the like. It is also contemplated that the entryway sensor array 12 can be connected to an external source of power as required (not shown). Entryway sensor array 12 is positioned such that the presence, movement and identity of a target worker T entering the room 170 can be ascertained. In the embodiment depicted, the entryway sensor array 12 is located on a wall 178 proximate to the doorway 176. It is also contemplated that the entry way sensor array 12 may be positioned on the associated door 176, on the lintel, or other suitable location. The entryway sensor array 12 can be configured to emit a suitable RFID signal or read one emitted by an RFID device 16 integrated into the worker identity tag worn by the targeted worker T depicted as entering the room. The entryway senor array 12 can include a suitable transmission device (not shown) that is configured to transmit pertinent data to the controller 20.

The rest room 170 can include at least one hand hygiene unit 18 that is associated with and proximate to one or more sink(s) 121. In the embodiment depicted in FIG. 4, the rest room 170 has three sinks 121 and two hand hygiene units 18 that are mounted on wall 179 proximate to the sinks 121. In certain embodiments, each hand hygiene unit 18 can include a suitable proximity sensor 24 that is integrated in the hand hygiene dispenser unit 18. The proximity sensor 24 is in electronic communication with the controller 20 that is integrated with the chamber 17 of an individual hand hygiene unit 18 as illustrated in FIG. 1. Alternately, a plurality of hand hygiene units can be ganged and electronically connected to a central controller 120.

Depending on the location of the controller 120 relative the plurality of hand hygiene units 18, the proximity sensor 24 can be located on the controller 120. Alternately, the individual hand hygiene units 18 can each be configured with a proximity sensor 24. As discussed previously, the proximity sensor 24 can be configured to identify the ID device 16 associated with the target worker T and convey data to the CPU 52 located in the controller. The CPU 52 can query the collected data to determine whether the ID device 16 that is perceived by the proximity sensor has been recently identified by the perimeter sensor array 12.

The signal emanating from entryway sensor array 12 can trigger a timer mechanism that is contained in the controller unit 20 of hand hygiene dispenser 18. Once a predetermined time has elapsed, the controller 20 can actuate an audible and/or visible warning alarm 62 designed to remind the target worker T that hand hygiene operations must be promptly attended to. The warning alarm 62 can be a type that directs the attention of the target worker T attention to the hand hygiene dispenser unit 18. This can be a light, a flashing light, an audible alarm or a combination of the same. It is within the purview of this disclosure that the intensity of the alarm can vary with elapsed time, for example to increase in intensity as time continues. In certain embodiments, activation of the alarm 62 can commence after a predetermined interval; typically, an interval sufficient to permit the average target worker T to use the bathroom facilities and to reach the dispenser unit 18. The alarm 62 can commence at the expiration of the predetermined interval and can increase in intensity as time elapses, if desired or required.

Once the target worker T reaches the hand hygiene dispenser 18, the worker ID badge 16 can be detected while the target worker T is proximate to the hand hygiene dispenser 18. This information can be conveyed to the CPU resident in the controller 20. That act followed at a close interval with the activation of the dispenser nozzle 26 or trigger 27 are construed as compliance and cause the CPU to construe that hand washing has been accomplished. This event, together with detection of the worker ID badge 16 by proximity sensor can result in production of a command signal to discontinue alarm activation and to record a compliance with hand washing protocol.

If the target worker T ignores the alarm 62 and fails to activate the nozzle 26 and trigger 27 of hand hygiene dispenser 18, the hand sanitation and monitoring system 10 can record the event as non-compliance and transmits the information to the remote detection device 28, 29. In certain embodiments, the non-compliance signal will be delayed until the departure of the target worker T from the monitored room 170 is detected by the sensor array 12. If the target worker T departs from the rest room 170 without triggering the hand hygiene device 18 and being detected proximate to the device 18, in addition to preparing a report on non-compliance as was discussed in conjunction with the embodiment in FIG. 3, the controller can issue a command to engage a notification alarm located on the externally position device such as cell hone 28. It is also within the purview of this disclosure to trigger and audible and/or visible alarm that is located in the food preparation and handling area.

The food worker system can also be linked to various gloving stations that are located remote to the rest room based system, in such embodiments, it is contemplated that the glove dispensing system will include one or more glove dispensing units that are located proximate to the food handing area which will activate to remind the worker T that gloving is required.

Figure 5:
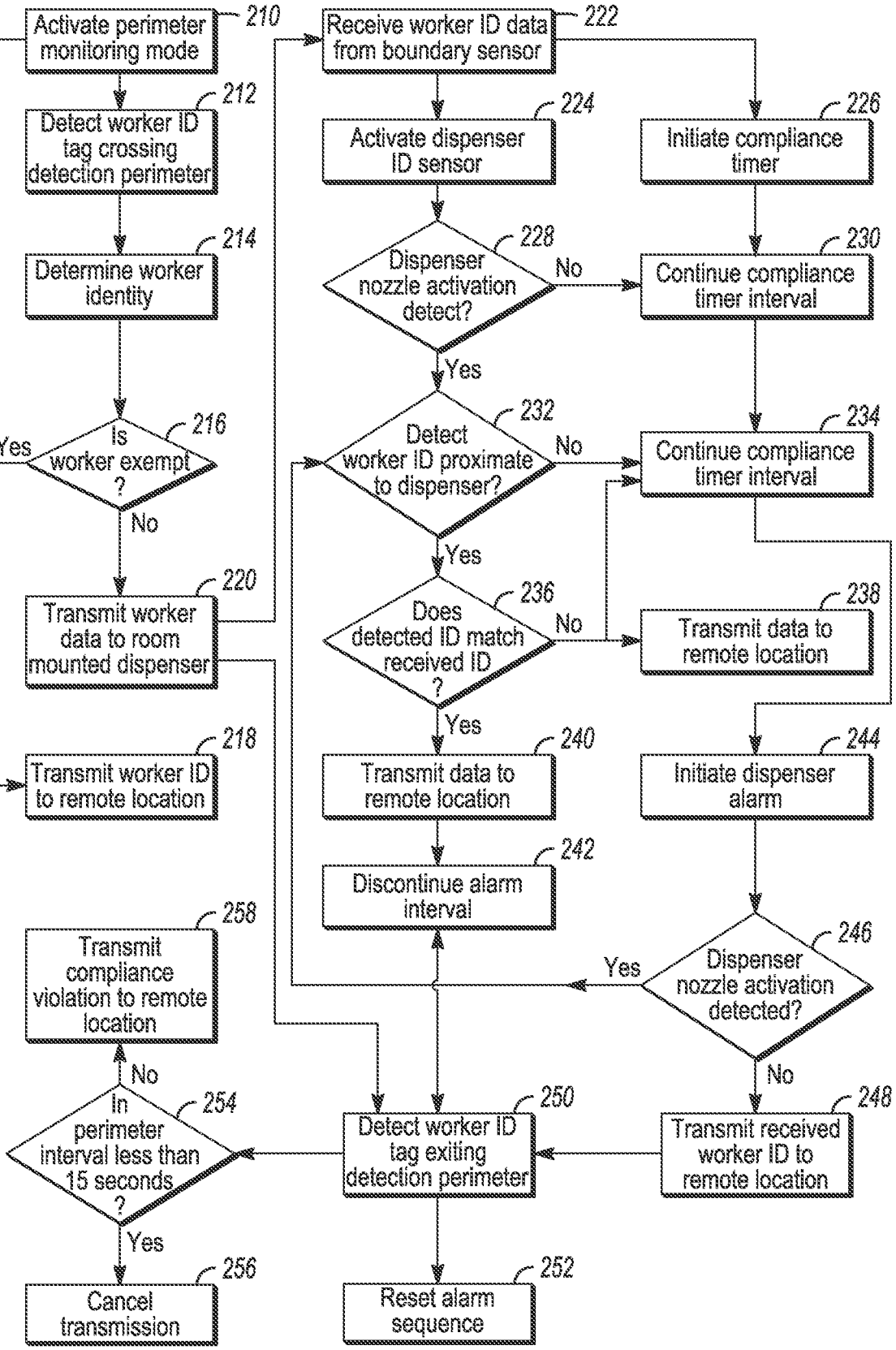
FIG. 5 is a process diagram for an embodiment of the process implemented in the schematic room of FIGS. 3A and 3B.

To further discuss the process resident in the hand sanitation and monitoring system 10 that is implemented in the embodiment depicted in association with FIG. 3, attention is directed to the process diagram in FIG. 5. As outlined in FIG. 5, during routine operation, the hand sanitation and monitoring system 10 as disclosed herein engages in active perimeter monitoring as at reference number 210. This can be accomplished by reading RFID chips present in worker ID badges that cross the defined perimeter as at reference numeral 212*a*. In situations where no activity is detected in a defined interval as at reference numeral 212*c*, that negative data can be transmitted as a message to the remote location as at reference numeral 216*d*. The defined interval can be preset by the health care institution. Where desired or required, it can be derived from health care industry norms for interaction between patient and health care personnel in a given care level situation. It is also contemplated that the level of interaction may vary given the time of day; with fewer more regular entrances occurring during nighttime hours. By way of non-limiting example, a no-activity report may be generated on the expiration of fifteen-minute intervals during evening hours in a standard care patient room and every 7 minutes during day time hours in that same room. A no-activity report may be generated after an interval of five minutes in an intensive care unit room.

It is contemplated that a certain number of consecutive no activity reports will generate a system inquiry command from the remote location to the hand sanitation and monitoring system 10 to assess performance.

Once a target worker T is identified by the hand sanitation and monitoring system 10 upon crossing the perimeter as at reference numeral 212, he identity of the target worker T is the determined as at reference number 214. The identity determination can be a simple class identification check to determine whether the worker is a patient care nurse, dietician worker, maintenance worker or the like. In certain classification protocol systems, it is contemplated that the necessary classification data can be resident on the chip present in badge 14 Alternately, personal identification information can be transmitted to the remote location for assessment and classification.

Figure 6A:
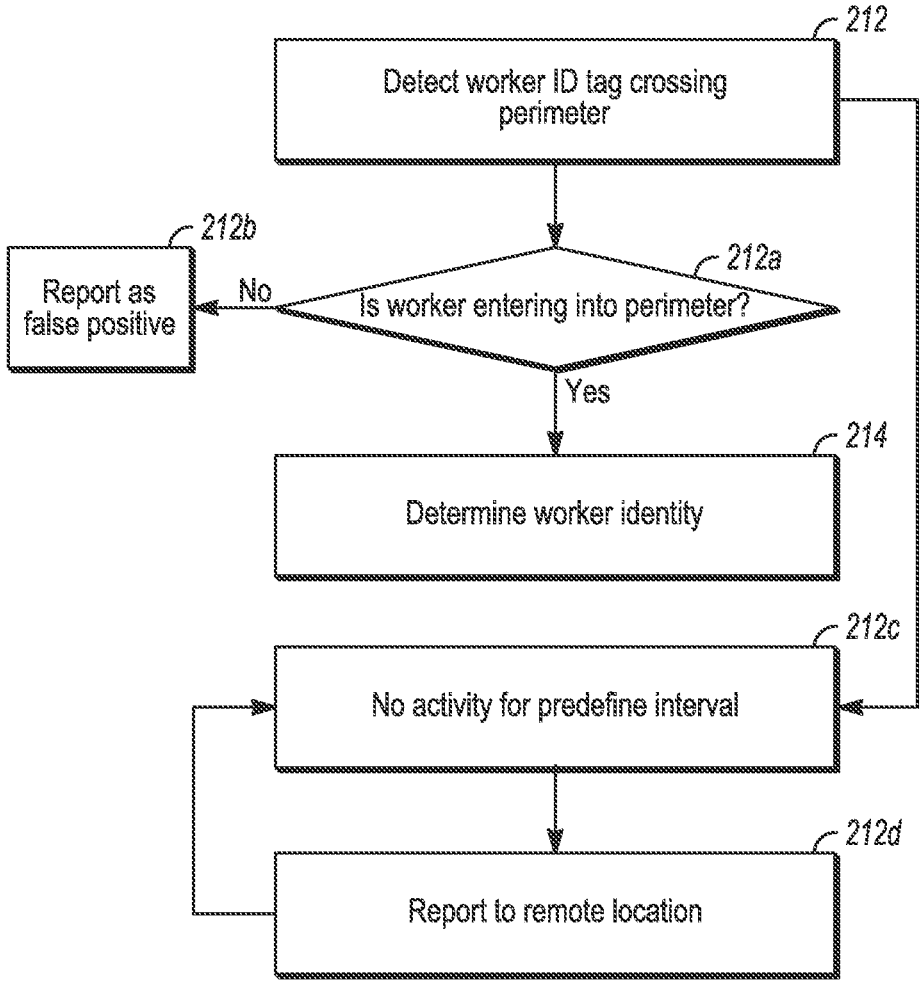
FIG. 6A is an embodiment of a first subroutine employed in the process outlined in FIG. 5.
Figure 6B:
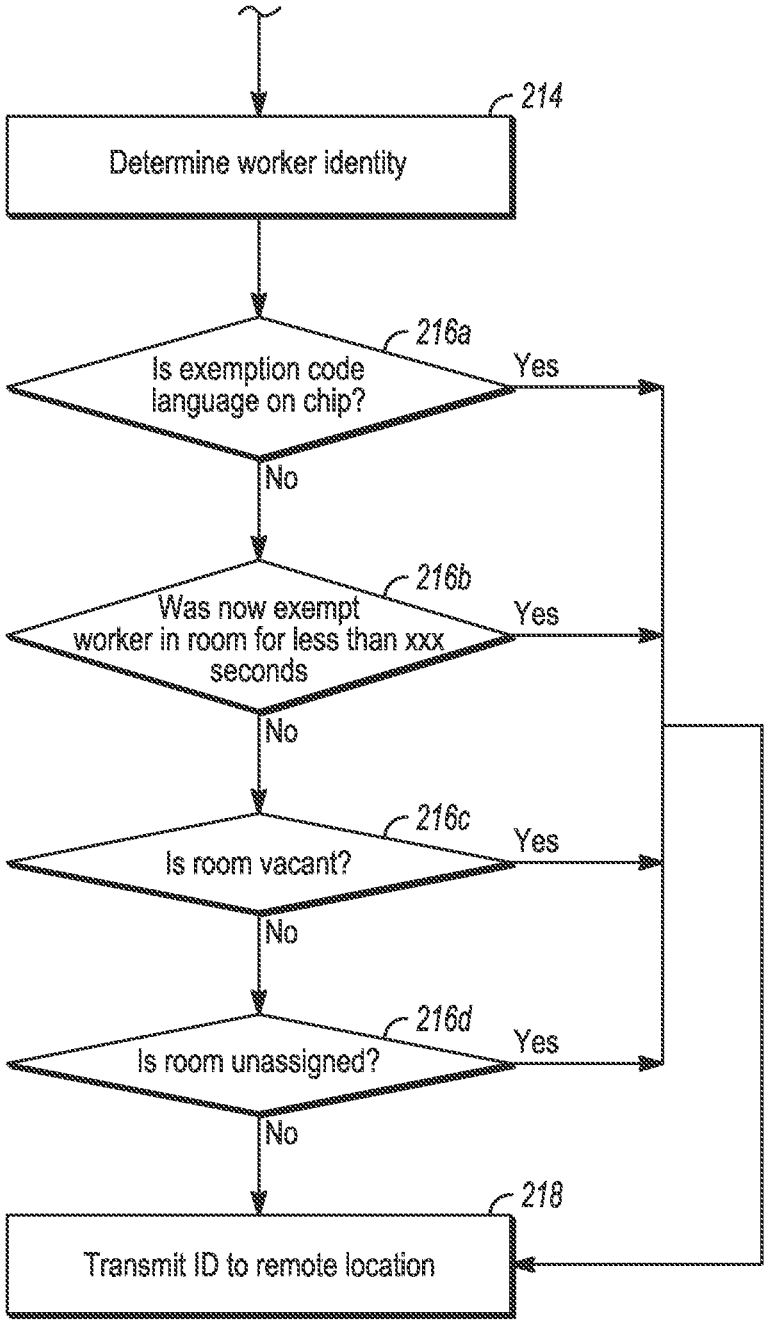
FIG. 6B is an embodiment of a second subroutine employed in the process outlined in FIG. 5.

One routine for determining worker exemption for the hand snatiation compliance method disclosed herein is presented in FIG. 6B. Once a target worker is identified as crossing the perimeter threshold, the target worker's identity can be determined for purposes of assessment for the hand washing compliance protocol as disclosed. This protocol can include a query to determine whether tan exemption code is present on the chip 16 embedded in the worker ID badge as at reference numeral 216*a*. If the worker is determined to be exempt, this development in transmitted to the remote location as at reference numeral 218. Where desired or require, this development can be transmitted with a time stamp and the worker identifier information for future macro analysis.

If the target worker is non-exempt from the mandated hand washing protocol, the on-board system timer can ascertain whether the non-exempt worker was present in the room for less than a predetermined number of seconds as at reference numeral 216*b*. This can be determined by a number of different analytics. In one non-limiting example, the sensor array 12 determines worker departure within a predetermined number of seconds, typically less time than it would take the worker to cross to the patient bed. 72, in which case the event can be reported to the remote location 218 and the alarm system on the dispenser 18 will not be activated.

If the worker is identified as being member of a class requiring gloving, the appropriate gloving commands will also be produced.

Other exemption events may occur based on room status for example if the associated room is considered vacant (i.e. the patient has been temporarily removed from the room for a treatment, procedure of the like) as at reference numeral 216*c* or the room is currently unassigned (the patient has been released from the hospital, transferred to another room, etc.) as at reference numeral 216*d*. It is contemplated that where hand washing system exemptions are room specific, the remote location data base associated with the hand sanitation and monitoring system 10 can be interfaced with suitable hospital systems to update such room status.

In the process as outlined above, if the target worker T is exempt, the process proceeds with step of transmitting material pertaining to the associated events to the remote location as at reference numeral 218. If the target worked T is not exempt, then the process proceeds as outlined in FIG. 5.

Once a target worker is determined to be non-exempt from the workplace mandated hand washing protocol, the worker ID data that was read by the sensor array 12 located at the boundary or perimeter of room R is transmitted to the controller 20 associated with hand washing dispenser 18 as at reference numeral 220 and received in the controller from the sensor array at reference numeral 222.

Reception of the targeted worker ID data at reference numeral 22 triggers potentially multiple activities within the controller 20. As depicted in the embodiment in FIG. 5, the hand hygiene dispenser sensor 24 is activated as to reference numeral 224 and the compliance timer present in the controller 20 is also initiated as at reference numeral 226.

Activation of the dispenser nozzle 26 and/or trigger mechanism 27 associated with the dispenser 28 is detected by controller 20 as at reference numeral 228. If no activation is detected, the compliance timer interval is continued as at reference numeral 230. If dispenser nozzle activation or activation of the trigger mechanism 27 is detected, the process proceeds to reference numeral 232 where the activated sensor 24 detects the target worker ID when the target worker T is in the region immediately proximate to the hand hygiene dispenser 18. Detection of the target worker ID proximate to the hand hygiene dispenser 18 can proceed by various modalities. Typically, the sensor 24 can function as an RFID device that can read information encoded in the corresponding RFID chip 16 embedded in the ID badge 14.

Figure 6C:
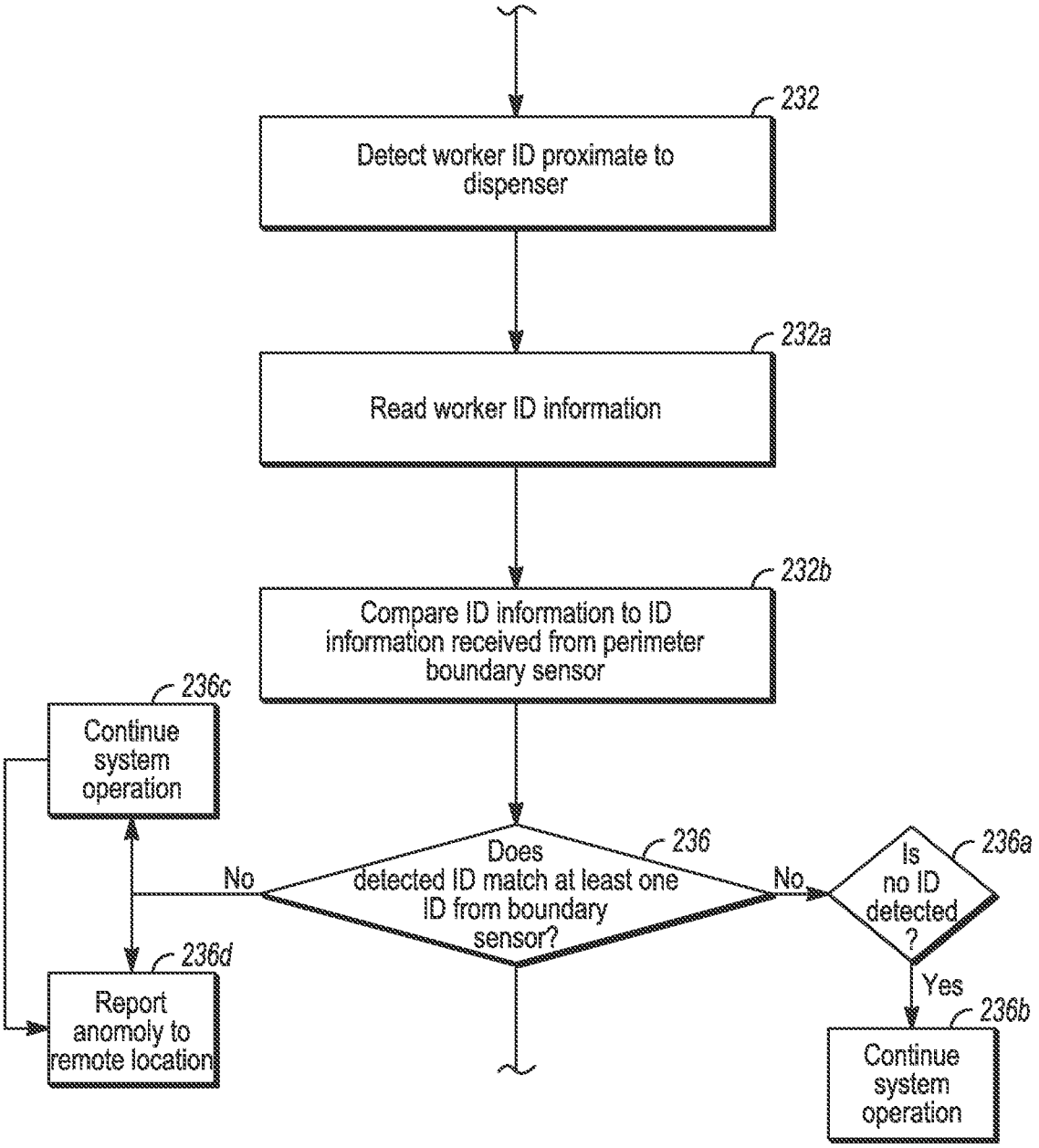
FIG. 6C is an embodiment of a third subroutine employed in the process outlined in FIG. 5.
Figure 6D:
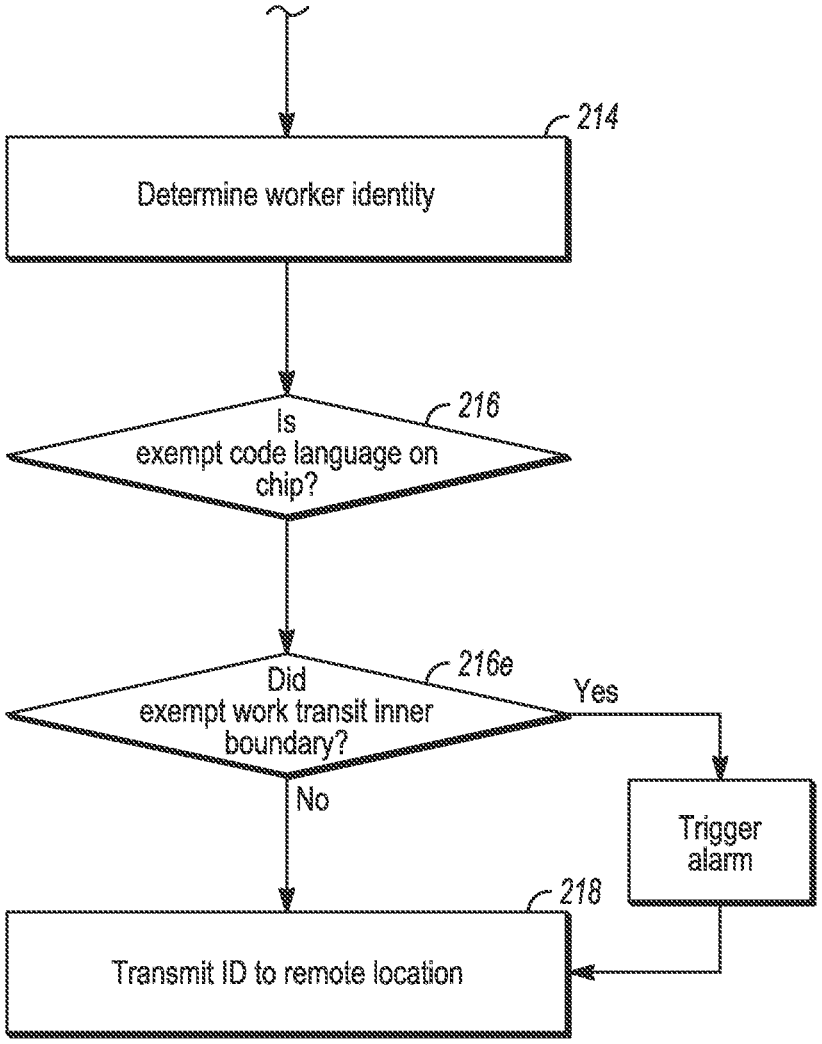
FIG. 6D is an embodiment of a fourth subroutine employed in the process in FIG. 5.
Figure 7:
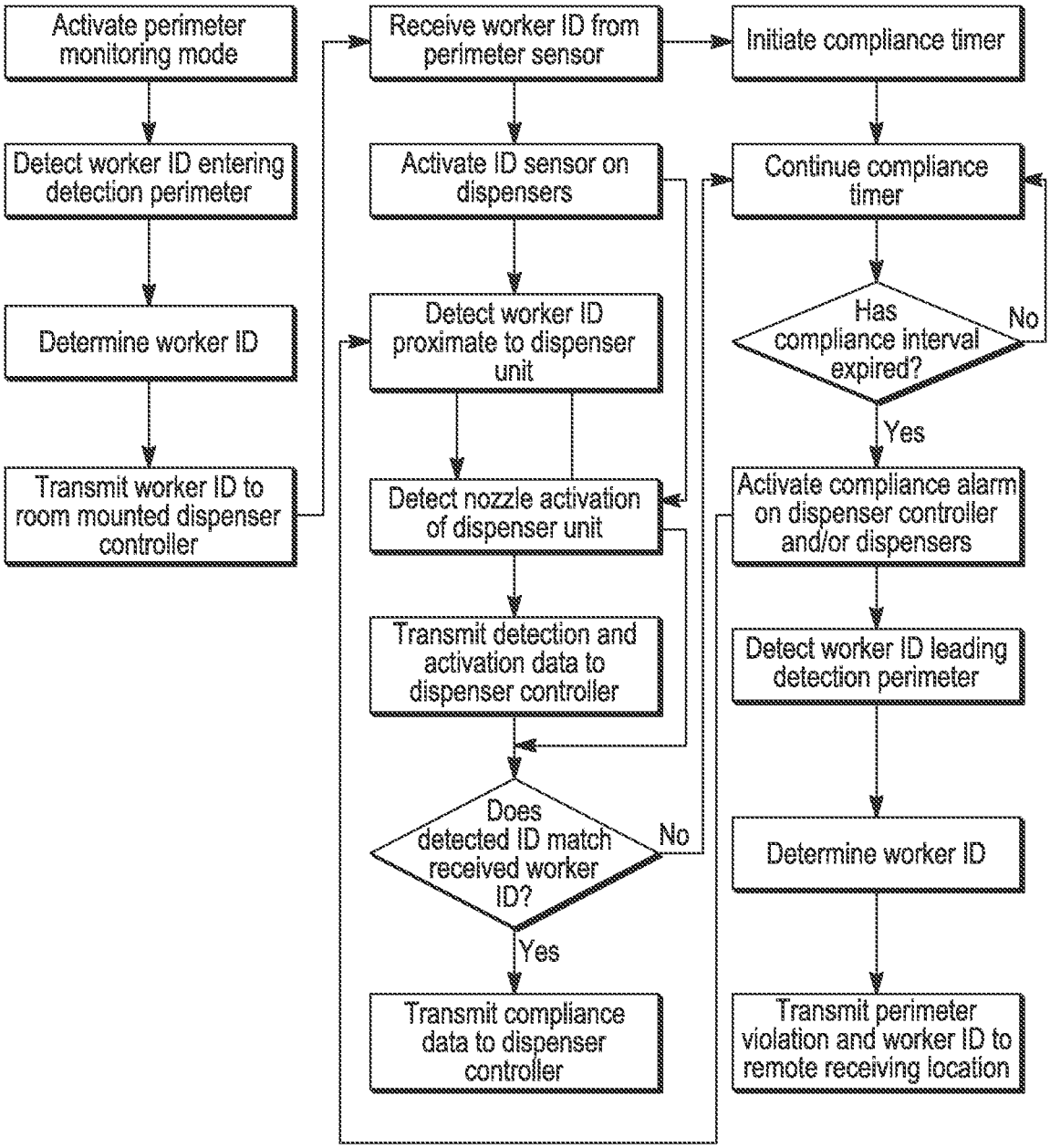
FIG. 7 is a process diagram for an embodiment of the process implemented in the schematic room of FIG. 4.
Figure 8:
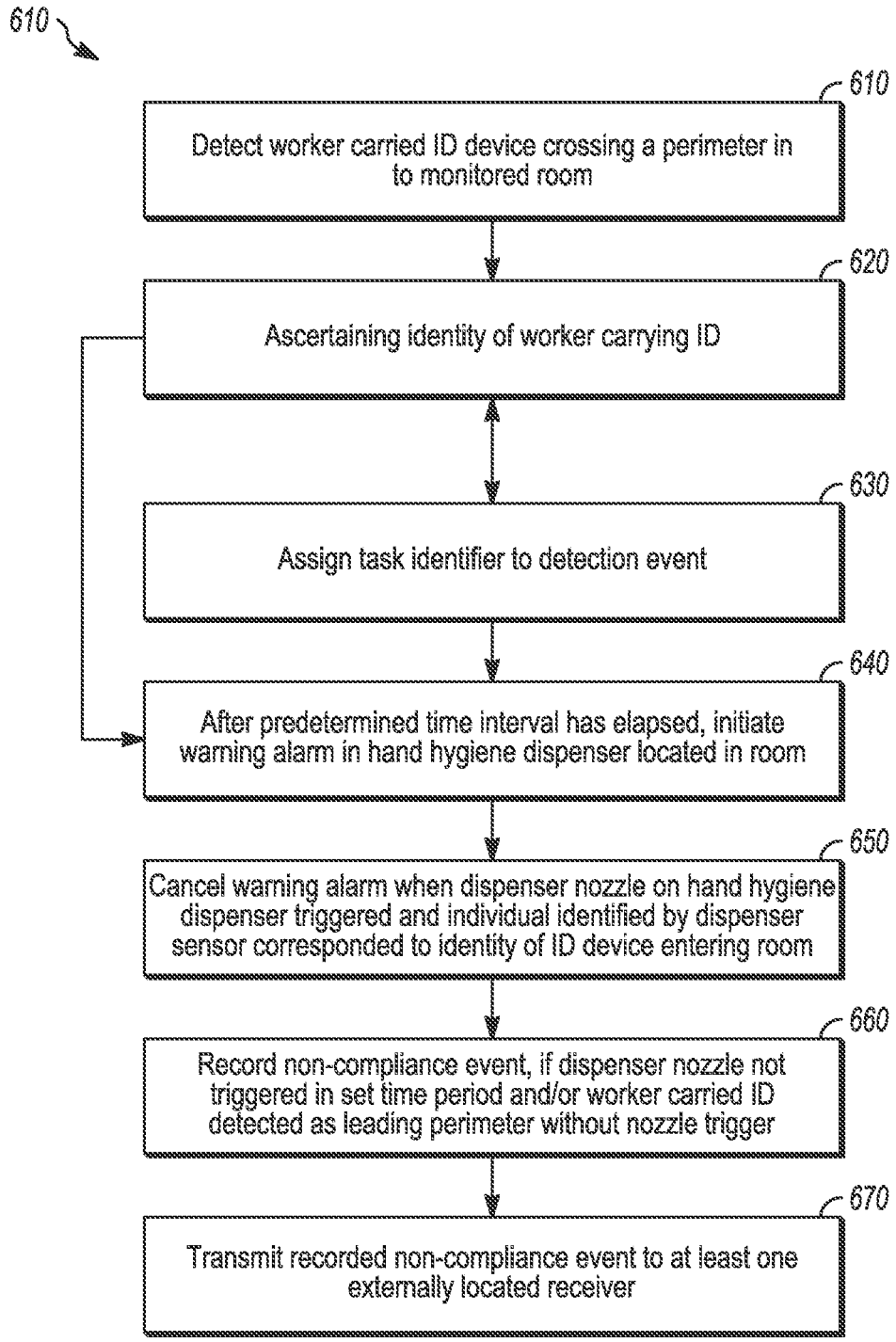
FIG. 8 is a flow chart of an embodiment of a method for encouraging employee compliance as disclosed herein.

In the embodiment as outlined in FIG. 5, the target worker ID is read by the activated hand hygiene sensor 24 as at reference numeral 232*a*. The read ID information derived from the sensor 24 is compared with the received ID information derived from the boundary sensor array 12 as at reference numeral 232*b* (see FIG. 6C). If no ID is detected at reference numeral 232 or if the ID does not match the received ID as at reference numeral 236, compliance timer operation will continue as at reference numeral 234. Where desired or required, ID mismatches are reported to remote location as at reference numeral 238. ID mismatches can be stored for further analysis and potential resolution. Operation of the hand washing compliance system 10 can continue in spite of ID mismatch as at reference numeral 236*b* with the anomalous data being handled offline for resolution.

It is also considered with in the purview of this disclosure to provide for an operation of sensor 24 and identification of the proximate ID 16 immediately prior to or contemporaneous with the activation of the trigger 27 or dispenser nozzle 26.

Establishing a match between ID data transmitted by sensor 12 and ID data read by the sensor 24 together with indication that the trigger 27 or nozzle 26 have been activated will result in a transmission of both ID specific and global compliance data to the remote location as at reference numeral 240 and issuance of a command that results in discontinuation of the alarm interval as at reference numeral 242.

In the alternative, the expiration of the of the compliance timer interval will produce a command to initiate the dispenser alarm as at reference numeral 244. The dispenser alarm can be any event that will draw attention to the dispenser 18 to remind the target worker T of the need to implement the employer-mandated handwashing protocol. The compliance timer interval will typically be an interval less than the time required for the target worker T to cross room 170 and contact the patient present in bed 172.

The alarm command can result in alarm actuation manifested as flashing lights, audible chimes, or a combination of both in certain embodiments. In the certain applications, it is contemplated that the intensity of the alarm will increase as the time of alarm activity continues. Alarm activity is discontinued upon activation of the dispenser nozzle 26 and/or trigger mechanism 27 as at reference numeral together with the detection of the target worker ID proximate to the dispenser 18 as detected by sensor 24. In the event that the detected ID does not match the ID detected by sensor array 12, the mismatched data can be transmitted to the remoted location for resolution.

In order to minimize patient disturbance, the alarm actuation interval can be timed and alarm operation can be discontinued after a defined interval or when the target worker T exits the room R as determined by sensor array 12 as at reference numeral. Worker exit can also trigger and alarm sequence rest as at reference numeral 252.

In certain embodiments, exit of the target worker T can also result in cancellation of operations as when the target worker T is within the perimeter such as room R for less than a defined interval, for example, 15 seconds as at reference numerals 254, 256. In the embodiment depicted in FIG. 5, residence in the room R for an interval greater than 15 seconds is considered a de facto compliance violation and is reports as such to the remote location as at reference numeral 258.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A hand hygiene system for use in a room having an entryway and in interior space comprising:

at least one hand cleaner dispenser unit having an outer housing defining an interior chamber containing a volume of a hand soap or sanitizing agent and a dispenser nozzle, the dispenser nozzle configured to release a measured amount of the hand soap or sanitizing agent upon a triggering event;

at least one control unit mounted to the hand cleaner dispenser unit, the control unit in electronic communication with the dispenser nozzle and/or a sensor, the control unit having at least one identity sensor, the identity sensor having a mechanism for determining a user located proximate to the dispenser unit, at least one alarm indicator and at least one transmitter;

at least one entryway proximity sensor in electronic communication with the control unit, the entryway proximity senor located a spaced distance from the at least one dispenser unit, wherein the entryway proximity sensor is configured to identify movement in a coordinate plane having an X-Y axis relative to an entry-egress portal, wherein the X axis traverses the portal and the Y axis is planar to the entry-egress portal, the entryway proximity sensor located proximate to the entry-egress portal, wherein the entryway proximity sensor is configured to identify and characterize movement in the X-axis plane from movement in the Y-axis plane; and at least one interior boundary sensor positioned at a suitable location in the interior of the associated room, the interior boundary sensor positioned to define at least a first room region and a second room region within the associated room with the at least one hand cleaner dispenser positioned in the first room region and a target unit being positioned in the second room region, wherein the interior boundary sensor is configured to identify and classify movement across the defined interior boundary relative to the target unit.

2. The hand hygiene system of claim 1 further comprising a central processing unit associated with one of the entryway proximity sensor or the dispenser unit and at least one remote transmission device mounted on either the proximity sensor or the dispenser unit, the transmission device in communication with at least one remote receiver unit.

3. The hand hygiene system of claim 2 further comprising a plurality of worker-specific identification devices, wherein the worker-specific identification devices can be indexed by sensors positioned on the at least one proximity sensor and the dispenser unit.

4. The hand hygiene device of claim 3 further comprising at least one programmed controller associated with the at least one control unit, the programmed controller having programming logic that compares the activation time of triggering of the at least one entryway proximity sensor or the interior boundary sensor located a spaced distance from the at least one dispenser with a programmed transit time to assess dispenser activation and classification of a detected worker-specific identification device.

5. The hand hygiene device of claim 4 further comprising at least one activation detection mechanism associated with the dispenser nozzle, the activation detection mechanism in operative connection with the programmed controller.

6. The hand hygiene device of claim 5 wherein the alarm indicator includes at least one of an audible alarm, a visible alarm and wherein the dispenser unit includes at least one alarm shut off mechanism, the alarm shut off mechanism operatively connected to the dispenser nozzle.

7. The hand hygiene system of claim 1 wherein the system is associated with at least one target unit and wherein the target unit is located within a perimeter defined by the at least one interior boundary sensor.

8. The hand dispenser system of claim 7 wherein the target unit is one of a patent bed, a patient wrist band, a medical device.

9. The hand hygiene system of claim 7 wherein the proximity sensor is further configured to identify a worker transiting the X-axis defined by the proximity sensor by a classification, wherein there are at least two worker classifications, a first worker classification triggering the preprogrammed activation time and a second worker classification that does not trigger the preprogrammed activation time.

10. The hand hygiene system of claim 9 further comprising an intermediate sensor, the intermediate sensor defining an inner boundary located between the portal and the target unit, the intermediate sensor configured detect forward movement of a worker toward the target unit.

11. A method for promoting and monitoring hand hygiene in a defined space comprising the steps of:

providing at least one interior room having a target unit and a portal defining a room boundary with at least one entryway proximity sensor proximate to the portal, wherein the entryway proximity sensor is configured to detect the presence and identity of at least one worker-carried identifier device as the identifier device crosses a predetermined room boundary associated with the at least one interior room, wherein the at least one worker-carried identifier device is either a general class worker-carried identifier device or an exempted class worker-carried identifier device;

providing the interior room with an interior room boundary sensor, the interior room boundary sensor defining at least one interior room boundary located between the portal and the target unit, the interior room boundary sensor configured detect forward movement of a worker into the room toward the target unit;

providing workers with either the general class worker-carried identifier device or the exempted class worker-carried identifier device;

detecting the exempted class worker-carried identifier device;

providing at least one hand cleaner dispenser unit configured with an interior chamber containing one of a hand soap or sanitizer material, the interior chamber accessible by a hand cleaner dispenser nozzle, the dispenser unit located in the interior room at a spaced distance from the entryway proximity sensor, the hand cleaner dispenser unit having at least one sensor configured to detect the presence of at least one worker-carried identification device at a location proximate thereto, at least one transmitter, a signal detector and at least one alarm member;

generating at least one signal in the entryway proximity sensor, the signal directed by the signal detector in the dispenser unit, wherein the generating step is triggered by detection of at least one worker-carried identifier device crossing the predetermined room boundary;

initiating a wait sequence interval wherein, upon receipt of the signal from the signal detector, the wait sequence terminates, termination occurring with receipt of an alarm signal from the dispenser or a predetermined interval, whichever is shorter; and when the hand cleaner dispenser nozzle is activated, determining the worker-carried identity device proximate to the hand cleaner dispenser device at the time of actuation.

12. The method of claim 11 further comprising the step of generating an alarm upon receipt of the alarm signal, the alarm having at least one physically detectable component, the physically detectable component being at least one of an audible sound, a visible light or signal.

13. The method of claim 12 further comprising the step of differentiating at least two classes worker-carried identifier devices wherein at least one class of worker-carried identifier devices is an exempted class and is configured to be detected by the entryway proximity sensor without triggering the signal generating step.

14. The method of claim 13 further comprises the steps of detecting the exempted class worker-carried identifier device; and calculating transit relative to the intermediate sensor, wherein transit over the inner boundary generates at least one signal in the intermediate sensor, the signal directed by the signal detector in the dispenser unit and generating at least one alarm activation signal.

15. The hand hygiene system of claim 1 further comprising at least one glove dispenser unit having an outer housing defining an interior chamber containing a plurality of individual disposable gloves and having a dispenser orifice, wherein the hand cleaner dispenser nozzle or the sensor of the hand cleaner dispenser unit is located proximate to the dispenser orifice on the glove dispenser.

16. The hand hygiene system of claim 15 further comprising:

a central processing unit associated with at least one of the entryway proximity sensor, the interior boundary proximity sensor, the hand cleaner dispenser unit and the glove dispenser unit and at least one remote transmission device mounted on either the entryway proximity sensor or the hand cleaner dispenser unit, the transmission device in communication with at least one remote receiver unit;

a plurality of worker-specific identification devices, wherein the worker-specific identification devices can be indexed by sensors positioned on the at least one proximity sensor and the hand cleaner dispenser unit.

17. The hand hygiene device of claim 16 further comprising:

at least one programmed controller associated with the at least one control unit, the programmed controller having programming logic that compares the activation time of triggering of the at least one entryway proximity sensor or the interior boundary sensor located a spaced distance from the at least one dispenser with a programmed transit time to assess dispenser activation and classification of a detected worker-specific identification device; and at least one activation detection mechanism associated with the hand cleaner dispenser nozzle, the activation detection mechanism in operative connection with the programmed controller.

* * * * *